US008261384B2

(12) United States Patent
Batiste et al.

(10) Patent No.: US 8,261,384 B2
(45) Date of Patent: Sep. 11, 2012

(54) BACK SUPPORT DEVICE

(76) Inventors: Stanley Batiste, Granite Bay, CA (US); Steven Achstein, Roseville, CA (US)

( * ) Notice: Subject to any disclaimer, the term of this patent is extended or adjusted under 35 U.S.C. 154(b) by 0 days.

(21) Appl. No.: 13/188,872

(22) Filed: Jul. 22, 2011

(65) Prior Publication Data

US 2012/0023663 A1 Feb. 2, 2012

Related U.S. Application Data

(60) Provisional application No. 61/366,868, filed on Jul. 22, 2010.

(51) Int. Cl.
*A47C 7/46* (2006.01)

(52) U.S. Cl. ..... 5/634; 297/284.5; 297/230.1

(58) Field of Classification Search ..... 5/633, 634; 297/230.1, 230.11, 284.1, 284.4, 284.5, 284.7; 602/19

See application file for complete search history.

(56) References Cited

U.S. PATENT DOCUMENTS

| | | | | |
|---|---|---|---|---|
| 2,191,360 | A * | 2/1940 | Westenbarger | 297/230.11 |
| 3,813,148 | A * | 5/1974 | Kraus | 297/230.14 |
| 4,597,386 | A * | 7/1986 | Goldstein | 602/19 |
| 5,190,347 | A * | 3/1993 | Shiow-Lan | 297/284.5 |
| 6,733,074 | B2 * | 5/2004 | Groth | 297/284.4 |
| 2008/0163427 | A1 * | 7/2008 | Howe | 5/634 |

* cited by examiner

*Primary Examiner* — Michael Trettel
(74) *Attorney, Agent, or Firm* — Weide & Miller, Ltd.

(57) ABSTRACT

A therapeutic back support device is disclosed which has adjustable curvature and portable thermal application. The back support device allows the user to change the curvature of the device to conform to the individual user's spine. The back support device includes include a support rib covered on one or more sides by padding. Built into the rib, padding, or both is a pocket or recess configured to accept a thermal cell. The thermal cell provides a heating or cooling cell to be placed within the pocket to thereby present heat or cold therapy to the user. On the back of the to device are one or more straps which may be length adjustable to maintain any degree of arch in the back support device.

19 Claims, 6 Drawing Sheets

BACK SUPPORT DEVICE

PRIORITY CLAIM

This application claims priority to and the benefit of U.S. Provisional Application No. 61/366,868 filed on Jul. 22, 2010 and entitled Back Support Device.

FIELD OF THE INVENTION

The invention relates to stretching devices and in particular to a device for supporting and stretching the human back and spine.

RELATED ART

Millions of Americans suffer from back pain which generally involves the cervical and lumbar spines. The majority of the back pain is related to spondylosis or what is generally called degenerative disease. Other contribution factors are related to poor posture, congenital or developmental back problems and prior history of back injury. Although a small percentage of these people may require surgery the majority can gain relief by improving posture and through means of physical therapy. In many cases simple back support allowing proper spinal alignment has been shown to improve or heal these problems.

While numerous back support and stretching devices have been proposed in the prior art, these devices suffer from numerous drawbacks. Numerous prior art devices are configured in a fixed configuration, such as a solid foam cylinder. Other devices are too ridged and do not adjust to the user's back. Yet other devices, such as a pillow or the like, are too soft and do not provide sufficient support.

The device disclosed below overcomes the drawbacks of the prior art and provides additional benefits as described.

SUMMARY

Disclosed is a back support device comprising a flexible support rib having a first end and a second end. Padding is provided around at least a portion of the support rib. An adjustable buckle having a first side and a second side is also provided and configured to connectively and releasably connect to the straps to adjust a curvature of the back support device. To maintain the art there is a a first strap having a first end and a second end such that the first end connects to or near the first end of the support rib and the second end of the first strap connected to a first side of the adjustable buckle. Likewise, a second strap is provided that has a first end and a second end such that the first end is connected to or near the second end of the support rib and the second end of the second strap connected to a second side of the adjustable buckle.

In one embodiment the back support device further comprising a pocket configured within the padding. The pocket is configured to house a thermal cell. It is also contemplated that the back support device may further comprise a thermal cell contained within the pocket. In one embodiment the thermal cell comprises a Sodium Acetate heat Pack. One embodiment of the back support device further comprising metallic insulative lining within the pocket. The back support device may have a cover over the pocket to provide material between a user and the thermal cell. In one configuration the back support device of claim 1, wherein the adjustable buckle comprises an automatic curvature adjustment mechanism and further comprising an elastic strap connected to an end of the support rib and an end of a first or second strap. As a result, in one embodiment the adjustment mechanism further comprising a release tab configured as part of the buckle, the release tab configured to release a strap to decrease the curvature of the back support device.

Also disclosed herein is a back support device comprising a flexible back support having a first end and a second end capable of being moved from a first position to a second position. When in the first position the ends are further away from one another than when in the second position and the second position establishes curvature in the flexible back support. This embodiment also includes at least one to first strap having a first end attached to the first end of the flexible back support. This embodiment also includes at least one second strap having a first end attached to the second end of the flexible back support. A connector is provided to connect to the second end of the first strap and the second end of the second strap. The connector is adjustably connected to at least one of the first strap and the second strap.

In one embodiment the back support device further comprises a recess in the flexible back support configured to house a heating or cooling pack. The back support device may further comprise a heating or cooling element configured as part of the flexible back support. In one configuration the back support device further comprises an elastic strap and the connector comprises an automatic curvature adjustment mechanism. Padding may be provided on at least one face of the flexible back support device. In one embodiment, the first end and the second end of the flexible back support comprises a connection point between a midpoint of the flexible back support and an end of the flexible back support.

Also disclosed herein is a method for using a back support device comprising first grasping a first end of the back support device and grasping a second end of the back support device. Then pressing the first end toward the second end to create an arch thereby decreasing the distance between a first strap connection point and a second strap connection point. As part of this method, automatically or manually, adjusting a strap buckle to secure one or more straps with the strap buckle to thereby maintain the arch in the back support device. Finally, once adjusted, a user would place the back support device adjacent a users back to provide support to the users back.

In one embodiment the method further comprises inserting a thermal cell into a pocket of the back support device. The thermal cell may comprise a sodium acetate heating pad and the method further comprises activating the thermal cell by activating a metal disc activating means which comprises a metal disc which initiate a reaction within the heating pad. For a user to use the back support device, the user may lie down on the back support device. It is also contemplated to increase the distance between the first strap connection point and the second strap connection point by adjusting the buckle or pressing a release lever associated with the buckle.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

The following invention is a therapeutic back support device which has adjustable curvature and portable thermal application. The device allows the user to change the curvature of the device to conform to each individual user's spine. Prior inventions only allow the apex of the curvature to be positioned centrally. By allowing the adjustment straps to be fixed at multiple points along a support rib, the device has the ability to adapt more naturally to the curvature of the human spine. The rib may comprise a sheet, band, rod, or other structure of any length or width.

The thermal application involves a thermal protected pocket which is inherited to the design. The thermal cell pocket allows placement of either a heating or a cooling cell which is then covered by cloth.

The description and mechanical function of the main components is now provided. In reference to FIG. 1, a perspective of the back support device is shown.

Figure 1:
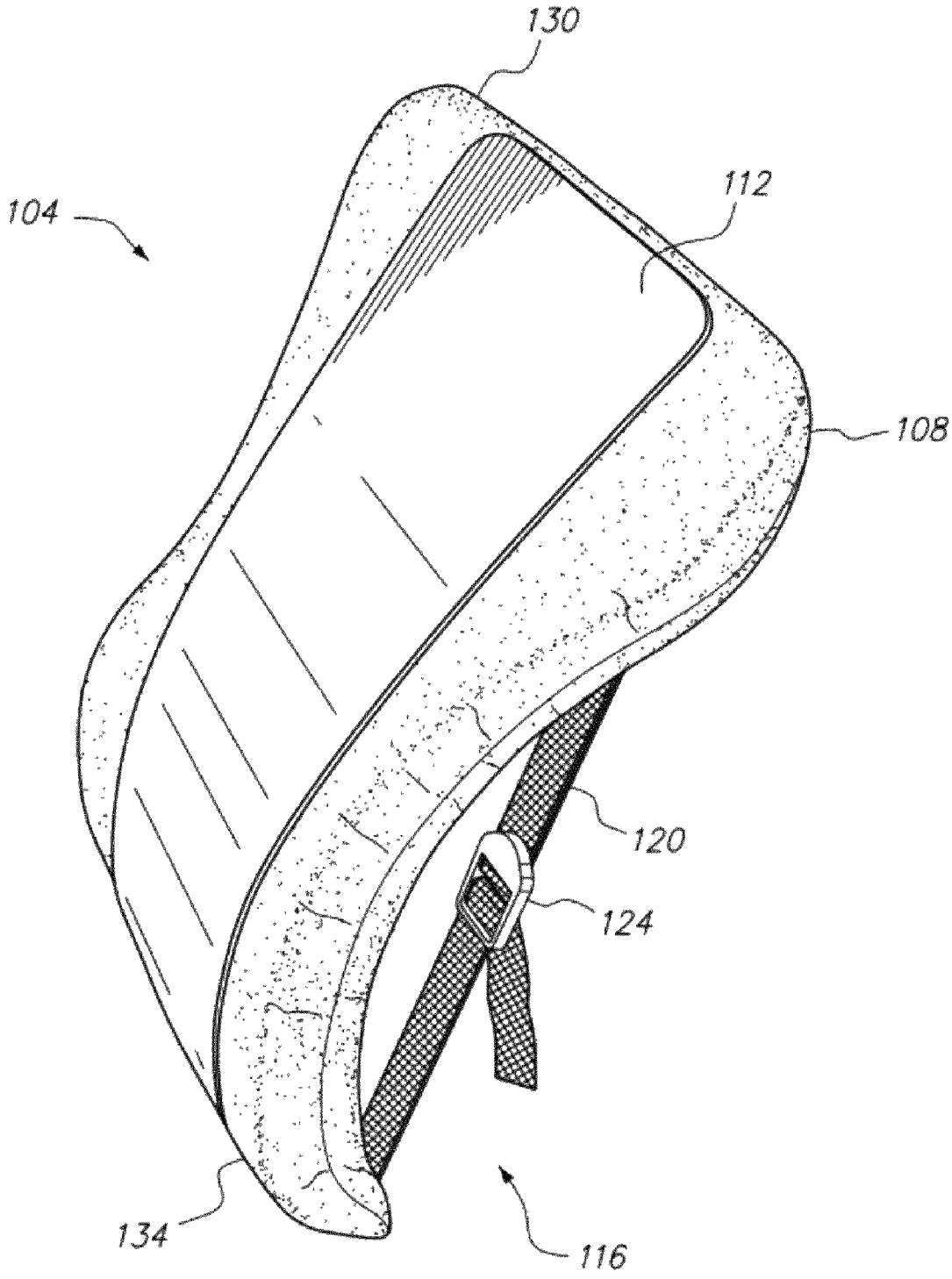
FIG. 1 illustrates a perspective view of an embodiment of the back support device.

As shown in FIG. 1, a back support device 104 comprises an outer padded shell having a first end 130 and a second end 134. The exterior of the back support device 104 is configured with foam 108 or other soft padding, such as fabric, batting, nylon, memory foam to add comfort to the user. The padding sandwiches a support rib, which is described below in greater detail. In addition to comfort, the foam padding allows for a recessed pocket (not shown in FIG. 1) suitable for carrying and supporting a therapeutic thermal cell. The pocket is covered in this embodiment by a cover 112 or shield which covers the thermal cell and tempering the thermal energy from the skin of the user.

The back support device 104 is also configured with a curvature 116 that generates an arch shape. The curvature 116 may be configured to match the curvature of a user's back. One or more adjustment straps 120 are connected to a back side of the back support device 104. The straps 120 have connectors or buckles 124 which allow the straps to be adjusted in length, which in turn adjusts the curvature of the curve 116. In this manner, the curvature 116 may be adjusted to match a user's back and provides a desired level of support or stretching.

Figure 2:
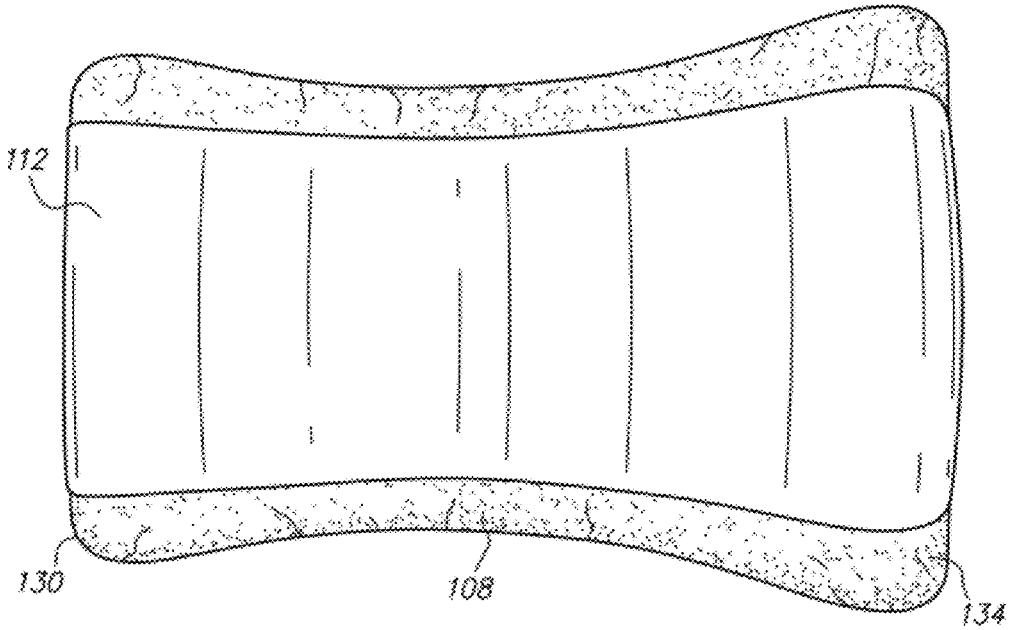
FIG. 2 illustrates a top view of an embodiment of the back support device.

FIG. 2 illustrates a top view of an embodiment of the back support device. The first side and second side 130, 134 are shown with the cover 112 on the top surface. The cover 112 may comprise sixe or shape and may configured based on the thermal cell within the pocket, discussed below. The foam or padding 108 is present on the sides and ends of the back support device 104 and may also be under the cover and shown below.

Figure 3:
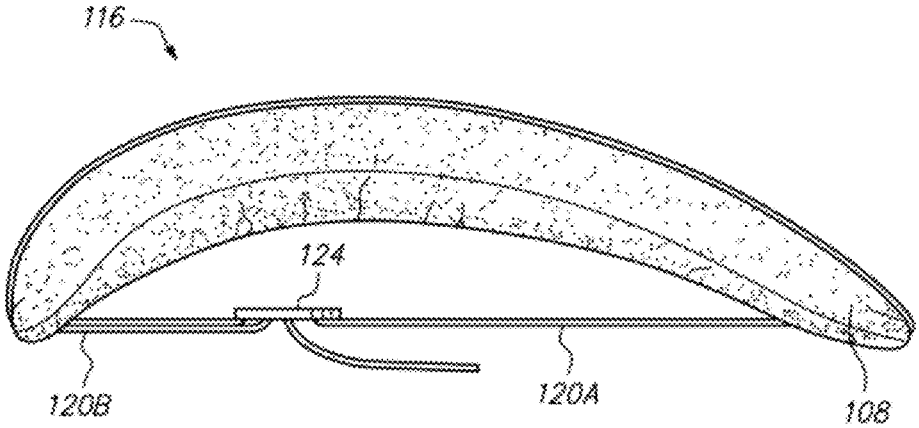
FIG. 3 illustrates a side view of an embodiment of the back support device.
Figure 4:
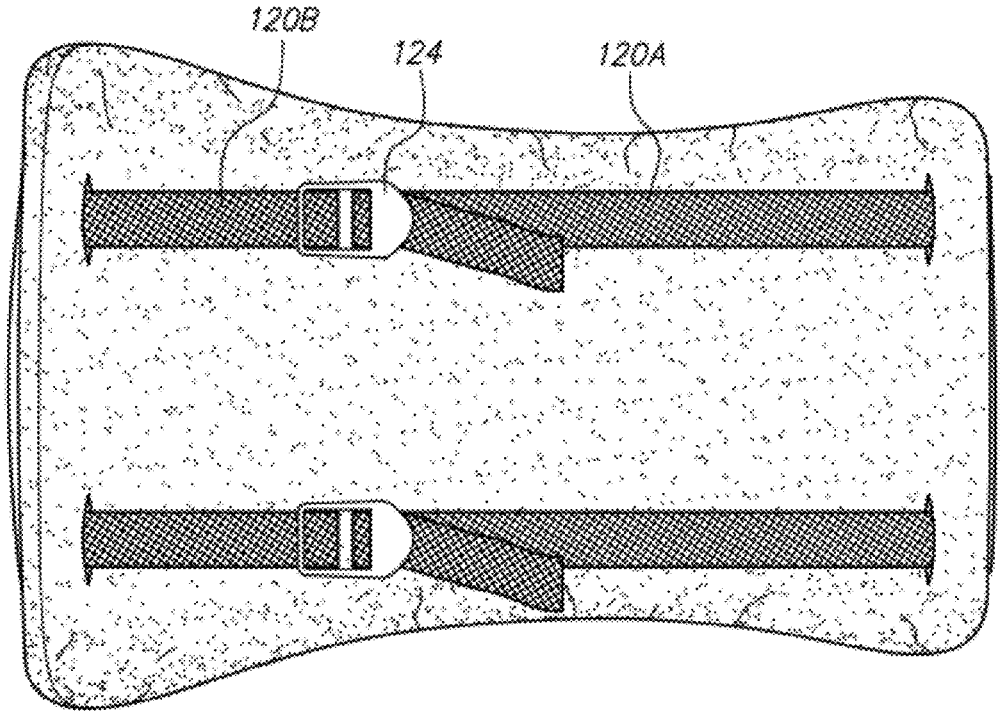
FIG. 4 illustrates a bottom view of an embodiment of the back support device.

FIG. 3 illustrates a side view of an embodiment of the back support device and FIG. 4 illustrates a bottom view of an embodiment of the back support device. These figures are discussed together. As shown, the side view in FIG. 3 shows the curvatures 116 creating an arch that may fit to a user's back and spine area. The steps 120A, 120B can be adjusted in length and secured using the buckle 124 to maintain the curvature 116 during use. By shorting or tightening the straps 120 the curvature is increased. The straps 120 connect to the interior support rib.

Figure 5:
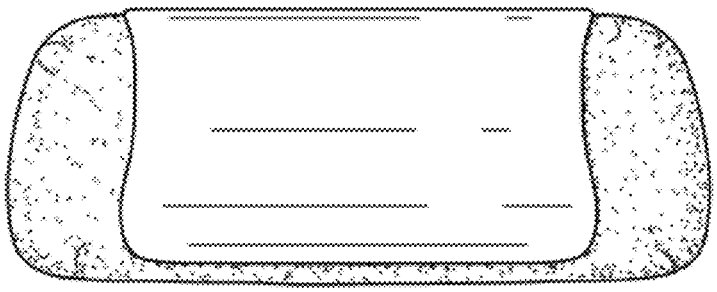
FIG. 5 illustrates a side view of an embodiment of the back support device.
Figure 6:
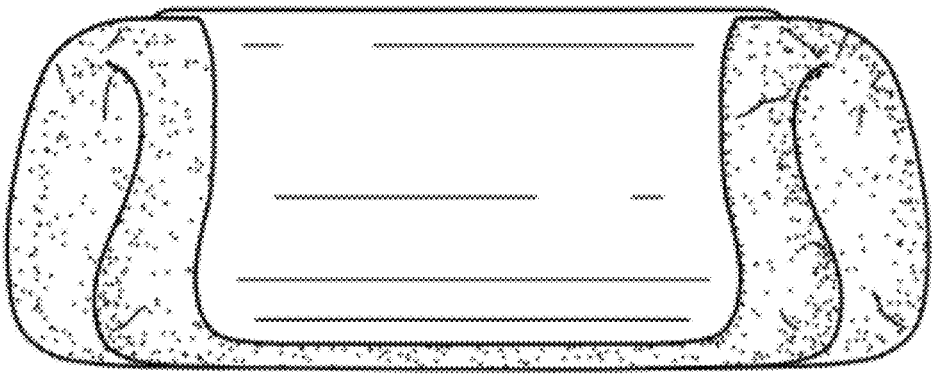
FIG. 6 illustrates a side view of an embodiment of the back support device.

FIGS. 5 and 6 illustrate end views of an embodiment of the back support device. These views show the first and second ends of the support device.

Figure 7:
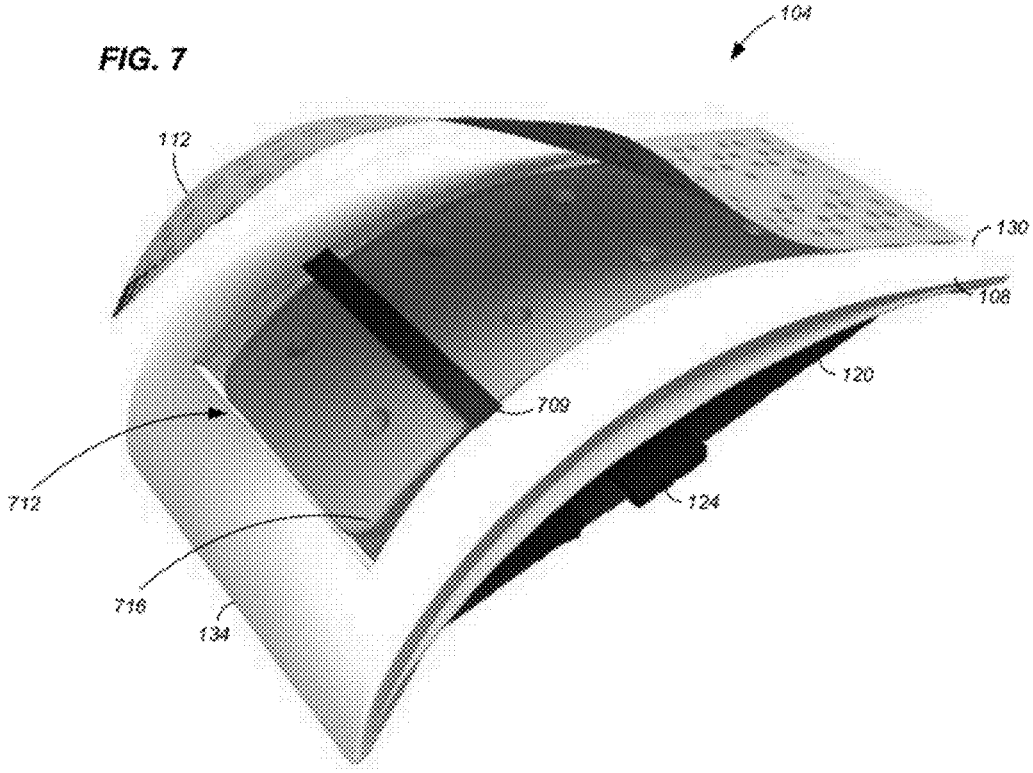
FIG. 7 illustrates the back support device and the pocket with the thermal cell.

FIG. 7 illustrates the back support device 104 and the pocket 712 with the thermal cell 716. The pocket 712 is formed or recessed within the top of the back support device. In other embodiment, the thermal cell 716 sits on top of the back support device 104.

In this example embodiment, within the thermal cell pocket there are one or more cell support straps 704 designed to keep the thermal cell from shifting during use or transport. In one embodiment, the thermal cell pocket 712 is lined with a metallic fabric or other insulative material designed and or selected for its low thermal transfer properties. This maintains more heat or cold transfer to the back of the user through the cover 112.

The thermal cell may comprise any type thermal element including but not limited to electric heating element, a pouch or container which may be heated and cooled, such as in freezer, cooler, stove, or microwave; hot bottle, or chemical based heating or cooling pouch filled with a chemical agent allowing for repeated thermal cycles. In one embodiment the cycle is to cool for 20 minutes and warm 45 minutes. The thermal cell may be flexible to conform to the arch of the back support device 104.

Figure 8:
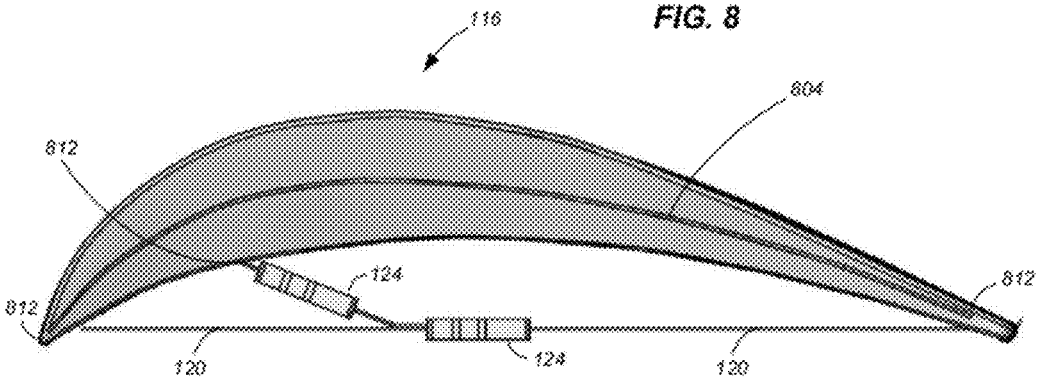
FIG. 8 illustrates an internal cut away side view of the back support device.

FIG. 8 illustrates an internal cut away side view of the back support device. This is but one possible configuration of the support rib 804 extending partially or entirely along the interior of the back support device. In one embodiment the support rib 804 is made of a polymer but in other embodiment the support rib may be made of any material that is rigid or that has some flexibility to create an adjustable arch 116. The support rib 804 functions much like the human spine that it was designed to support the weight of the user when the user leans against or on the back support device. The support rib 804 takes on its compound curvature by connecting opposing sides of the rib via a curvature adjustment strap 120. The adjustment strap is expanded or contracted thus modifying the degree of curvature. The strap 120 connects to the spine 804 and the ends of the spine 812 and thus when the straps are shortened, the arch increases. In this way, the straps are compound adjustment straps in that the curve that is create is compound in nature, which is a benefit of prior art system.

Also disclosed herein is an automatic tension mechanism for strap length adjustment as shown in FIGS. 9, 10 and 11. The back support device, configured as a lumbar support, also has the capability to provide an automatically adjustable curvature which will more easily provide a means of lumbar extension therapy. As disclosed below, in one embodiment the user manually adjusts the ridged but flexible polymer rib support by the user physically deforming the body (rib support) and then manually tightening the adjustment straps for position adjustment. Although functional, it was contemplated that an improvement could be made that would allow the user to deform the back support device manually, then have the straps adjust automatically, thus making the operation easier and simpler.

Figure 9A:
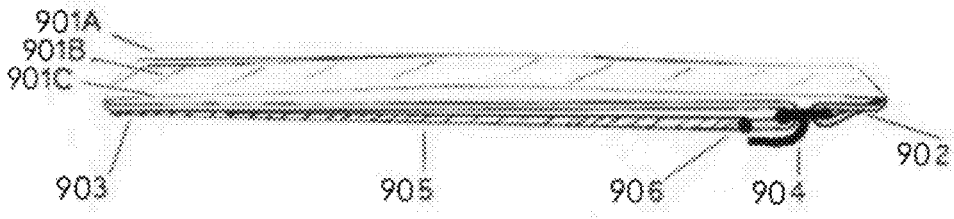
FIGS. 9A-9C illustrates an automatic curvature adjustment mechanism of the back support device.

In general, the automatic curvature adjustment mechanism (hereinafter ACAM) is composed of the six main components which are shown generally in FIGS. 9A-9C. These elements are set forth in the following list and then described below in greater detail. In this embodiment the elements are:

901 back support device main body components:
901A optional decorative cover
901B foam padding
901C support rib
902 fixed anchor strap (FAS)
903 adjustable anchor strap (AAS)
904 ladder style locking buckle
905 elastic strap
906 adjustable anchor strap/elastic strap junction FIG. 9A illustrates a side view of the back support is composed of the padding 901B and the optional decorative cover 901A. The interior of the back support device is composed of or comprises the support rib 901C. Connecting to the support rib 901C are the straps 902, 903. In this embodiment one strap is a fixed anchor strap 902 while the other strap is the adjustable anchor strap. Connecting to the straps 902, 903 is the automatic curvature adjustment mechanism (ACAM) 904, 905, 906. The following discussion focuses on the support rib 901C and its relation to the ACAM 904, 905, 906.

As first end of the fixed anchor strap 902 attaches at one end to an end or near an end point of the support rib 901C. A second end of the fixed anchor strap 902 attaches to the locking buckle 904.

A first end of the adjustable anchor strap 903 attaches to an opposing end or near an opposing end of the support rib 901C. The second end of the adjustable anchor strap 903 advanced through the ladder configuration of the Locking Buckle 904. The second end of the adjustable anchor strap 903 is then fixed to a first end of the elastic strap 905 at the junction 906. A second end of the elastic strap 905 is then fixed to an end or near an end of the support rib 901C as shown.

Figure 9B:
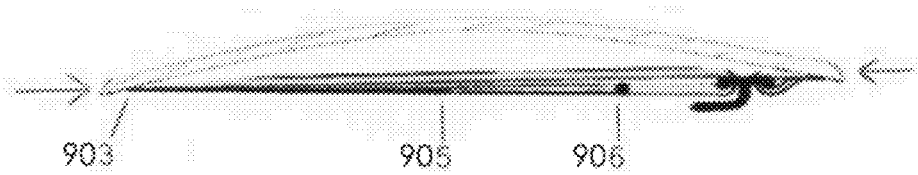

In adjustment phase operation and in reference to FIG. 9B, as pressure is exerted by a user on the first and second ends (shown by arrows) of the back support device, support rib deforms to increase the arch angle to provide the desired curvature for the user. Once the support rib 901C is deformed, there will be slack created in the adjustable anchor strap 903 as the increase in the arch decreases the distance between the two ends of the support rib. The slack however is immediately taken up by the tension of the elastic strap 905 keeping the adjustable anchor strap 903 always tight. As can be seen, the advanced position of the elastic strap junction 906 in FIG. 9B illustrates that the elastic strap junction has moved relative to its position in FIG. 9A. In one embodiment the buckle comprises a ladder style locking buckle. In one position, parallel to the straps, the ladder style locking buckle allows unidirectional passage of the strap shortening the length between the arch. When the arch tension is released, the ladder style locking buckle hold the tension between the two straps keeping the arch in its desired degree of curvature. The tension between the two straps can be released by lifting the end of the ladder style locking buckle away from the arch of the device. This motion changes the orientation of the ladder style locking buckle in relation to the straps decreasing the friction and thus allowing the straps to slide freely and as a result increases their relative length, decreasing the degree of curvature of the arch.

The ACAM thus eliminates the need for the user to perform the complex process of manually adjusting the straps while the user also holds the desired amount of curvature in the support rib 901C.

Figure 9C:
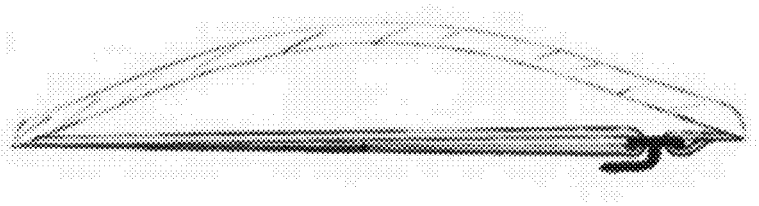

As shown in FIG. 9C, once the desired curvature is created, and the slack is taken up by the strap and buckle system, the user provided pressure on the ends of the support rib 901C can be released. At this point the tension created from the curvature is transferred to the adjustment anchor strap 903 which is held secure by the locking buckle 904.

As a result of the design of the ACAM, the user may adjust the back support device in its neutral position by applying pressure on the first and second ends of the back support device to establish the desired curvature. The ACAM automatically adjusts the straps to maintain the desired curvature and the user may immediately use the back support device. This ACAM design does not requires the user to pull on the straps for adjustment as it is automatically done by the elastic straps. Releasing the tension is easily done by lifting tabs on the locking buckle 904 which then releases the adjustable anchor strap 903 thereby allowing the support rib 901C to straighten out into its neutral position as shown in FIG. 9A.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A back support device comprising:
a flexible support rib having a first end and a second end;
padding around at least a portion of the support rib with a pocket configured within the padding, the pocket configured to house a thermal cell;
an adjustable buckle having a first side and a second side and configured to connectively and releasably connect to at least one strap to adjust a curvature of the back support device such that the at least one strap includes;
a first strap having a first end and a second end, the first end connected to or near the first end of the support rib and the second end of the first strap connected to a first side of the adjustable buckle; and
a second strap having a first end and a second end, the first end connected to or near the second end of the support rib and the second end of the second strap connected to a second side of the adjustable buckle.

2. The back support device of claim 1, further comprising the thermal cell contained within the pocket.

3. The back support device of claim 2, wherein the thermal cell comprises a sodium acetate heat pack.

4. The back support device of claim 1, further comprising metallic insulative lining within the pocket.

5. The back support device of claim 1, further comprising a cover over the pocket to provide material between a user and the thermal cell.

6. The back support device of claim 1, wherein the adjustable buckle comprises an automatic curvature adjustment mechanism and further comprising an elastic strap connected to an end of the support rib and an end of a first or second strap.

7. The back support device of claim 6 further comprising a release tab configured as part of the buckle, the release tab configured to release a strap to decrease the curvature of the back support device.

8. A back support device comprising:
a flexible back support having a recess configured to house a heating or cooling pack, the flexible back support also having a first end and a second end capable of being moved from a first position to a second position, wherein when in the first position the ends are further away from one another than when in the second position and the second position establishes curvature in the flexible back support;

at least one first strap having a first end attached to the first end of the flexible back support;

at least one second strap having a first end attached to the second end of the flexible back support; and a connector connected to the second end of the first strap and the second end of the second strap, wherein the connector is adjustably connected to at least one of the first strap and the second strap.

9. The back support device of claim 8, further comprising a heating or cooling element configured as part of the flexible back support.

10. The back support device of claim 8, further comprising an elastic strap and the connector comprises an automatic curvature adjustment mechanism.

11. The back support device of claim 8, further comprising padding on at least one face of the flexible back support device.

12. The back support device of claim 8, wherein the first end and the second end of the flexible back support comprises a connection point between a midpoint of the flexible back support and an end of the flexible back support.

13. A method for using a back support device comprising:

grasping a first end of the back support device;

grasping a second end of the back support device;

pressing the first end toward the second end to create an arch thereby decreasing the distance between a first strap connection point and a second strap connection point;

automatically or manually, adjusting a strap buckle to secure one or more straps with the strap buckle to thereby maintain the arch in the back support device;

placing the back support device adjacent a user's back to provide support to the user's back, wherein the method further comprises inserting a thermal cell into a pocket of the back support device.

14. The method of claim 13, wherein the thermal cell comprises a sodium acetate heat pad and the method further comprising activating disc activating means which comprises a disc which initiate a reaction within the heat pad.

15. The method of claim 13, further comprising lying down on the back support device.

16. The method of claim 13, further comprising increasing the distance between the first strap connection point and the second strap connection point by adjusting the buckle or pressing a release lever associated with the buckle.

17. A back support device comprising:

a flexible support rib having a first end and a second end;

padding around at least a portion of the support rib;

an adjustable buckle having a first side and a second side and configured to connectively and releasably connect to at least one strap to adjust a curvature of the back support device such that the at least one strap includes;

a first strap having a first end and a second end, the first end connected to or near the first end of the support rib and the second end of the first strap connected to a first side of the adjustable buckle; and a second strap having a first end and a second end, the first end connected to or near the second end of the support rib and the second end of the second strap connected to a second side of the adjustable buckle, wherein the adjustable buckle comprises an automatic curvature adjustment mechanism and further comprising an elastic strap connected to an end of the support rib and an end of a first or second strap.

18. A back support device comprising:

a flexible back support having a heating or cooling element configured as part of the flexible back support, the flexible back support further having a first end and a second end capable of being moved from a first position to a second position, wherein when in the first position the ends are further away from one another than when in the second position and the second position establishes curvature in the flexible back support;

at least one first strap having a first end attached to the first end of the flexible back support;

at least one second strap having a first end attached to the second end of the flexible back support; and a connector connected to the second end of the first strap and the second end of the second strap, wherein the connector is adjustably connected to at least one of the first strap and the second strap.

19. A back support device comprising:

a flexible back support having a first end and a second end capable of being moved from a first position to a second position, wherein when in the first position the ends are further away from one another than when in the second position and the second position establishes curvature in the flexible back support;

at least one first strap having a first end attached to the first end of the flexible back support;

at least one second strap having a first end attached to the second end of the flexible back support; and a connector connected to the second end of the first strap and the second end of the second strap, such that the connector comprises an automatic curvature adjustment mechanism and the connector is adjustably connected to at least one of the first strap and the second strap and at least one of the first strap and the second strap is an elastic strap.

* * * * *